United States Patent [19]

Burk, Jr. et al.

[11] 4,270,926

[45] Jun. 2, 1981

[54] PROCESS FOR REMOVAL OF SULFUR AND ASH FROM COAL

[75] Inventors: Emmett H. Burk, Jr., Glenwood; Jui-Yuan Sun, South Holland; Lloyd A. Baillie, Homewood, all of Ill.

[73] Assignee: Atlantic Richfield Company, Philadelphia, Pa.

[21] Appl. No.: 50,262

[22] Filed: Jun. 19, 1979

[51] Int. Cl.[3] ..... C10L 9/00; C10L 9/02

[52] U.S. Cl. ..... 44/1 SR; 209/5; 209/164

[58] Field of Search ..... 44/1 SR, 24; 209/5, 209/49, 171, 173, 164, 207

[56] References Cited

U.S. PATENT DOCUMENTS

| | | | |
|---|---|---|---|
| 3,458,044 | 7/1969 | Moss et al. | 209/164 X |
| 3,747,757 | 7/1973 | Kalthoff et al. | 209/164 |

*Primary Examiner*—Carl F. Dees

*Attorney, Agent, or Firm*—John B. Goodman

[57] ABSTRACT

A process for reducing the sulfur and ash content of coal wherein coal particles are treated in an aqueous slurry with a minor amount of hydrocarbon oil to form coal-oil aggregates. The coal-oil aggregates are separated from ash and mineral matter in the slurry by dissolved gas flotation. Optionally, the coal particles may be treated with a conditioning agent prior to the aggregation step. Recovered coal particles comprise a substantial part of the feed carbon values.

31 Claims, No Drawings

PROCESS FOR REMOVAL OF SULFUR AND ASH FROM COAL

BACKGROUND OF THE INVENTION

This invention relates to a process for reducing the sulfur content of coal.

It is recognized that an air pollution problem exists whenever sulfur-containing fuels are burned. The resulting sulfur oxides are particularly objectionable pollutants because they can combine with moisture to form corrosive acidic compositions which can be harmful and/or toxic to living organisms in very low concentrations.

Coal is an important fuel and large amounts are burned in thermal generating plants primarily for conversion into electrical energy. Many coals generate significant and unacceptable amounts of sulfur oxides on burning. The extent of the air pollution problem arising therefrom is readily appreciated when it is recognized that coal combustion currently accounts for 60 to 65% of the total sulfur oxides emissions in the United States.

The sulfur content of coal, nearly all of which is emitted as sulfur oxides during combustion, is present in both inorganic and organic forms. The inorganic sulfur compounds are mainly iron pyrites, with lesser amounts of other metal pyrites and metal sulfates. The organic sulfur may be in the form of thiols, disulfides, sulfides and/or thiophenes chemically associated with the coal structure itself. Depending on the particular coal, the sulfur content may be primarily either inorganic or organic. Distribution between the two forms varies widely among various coals. For example, both Appalachian and Eastern interior coals are known to be rich in both pyritic and organic sulfur. Generally, the pyritic sulfur represents from about 25% to 70% of the total sulfur content in these coals.

Heretofore, it has been recognized to be highly desirable to reduce the sulfur content of coal prior to combustion. In this regard, a number of processes have been suggested for physically reducing the inorganic portion of the sulfur in coal. Organic sulfur cannot be physically removed from coal.

As an example, it is known that at least some pyritic sulfur can be physically removed from coal by grinding and subjecting the ground coal to froth flotation or washing processes. These processes are not fully satisfactory because a significant portion of the pyritic sulfur and ash are not removed. Attempts to increase the portion of pyritic sulfur removed have not been successful because these processes are not sufficiently selective. Because the processes are not sufficiently selective, attempts to increase pyrite removal can result in a large portion of coal being discarded along with ash and pyrite.

There have also been suggestions heretofore to remove pyritic sulfur from coal by chemical means. For example, U.S. Pat. No. 3,768,988 discloses a process for reducing the pyritic sulfur content of coal by exposing coal particles to a solution of ferric chloride. The patent suggests that in this process ferric chloride reacts with pyritic sulfur to provide free sulfur according to the following reaction process:

$$2FeCl_3 + FeS_2 \rightarrow 3FeCl_2 + 2S$$

While this process is of interest for removing pyritic sulfur, a disadvantage of the process is that the liberated sulfur solids must then be separated from the coal solids. Processes involving froth flotation, vaporization and solvent extraction are proposed to separate the sulfur solids. All of these proposals, however, inherently represent a second discrete process step, with its attendant problems and cost, to remove the sulfur from coal. In addition, this process is notably deficient in that it does not remove organic sulfur from coal.

In another approach, U.S. Pat. No. 3,824,084 discloses a process involving grinding coal containing pyritic sulfur in the presence of water to form a slurry, and then heating the slurry under pressure in the presence of oxygen. The patent discloses that under these conditions the pyritic sulfur (for example, $FeS_2$) can react to form ferrous sulfate and sulfuric acid which can further react to form ferric sulfate. The patent discloses that typical reaction equations for the process at the conditions specified are as follows:

$$FeS_2 + H_2O + 2O_2 \rightarrow FeSO_4 + H_2SO_4$$

$$2FeSO_4 + H_2SO_4 + \tfrac{1}{2}O_2 \rightarrow Fe_2(SO_4)_3 + H_2O.$$

Accordingly, the pyritic sulfur content continues to be associated with the iron as sulfate. Several factors detract from the desirability of this process. High temperatures and pressures are employed which can necessitate the use of expensive reaction vessels and processing plants of complex mechanical design. Because high temperatures are employed, excessive amounts of energy can be expended in the process. In addition, the above oxidation process is not highly selective in that considerable amounts of coal itself are oxidized. This is undesirable, of course, since the amount and/or heating value of the coal recovered from the process is decreased.

Heretofore, it has been known that coal particles could be agglomerated with hydrocarbon oils. For example, U.S. Pat. Nos. 3,856,668 and 3,665,066 disclose processes for recovering coal fines by agglomerating the fine coal particles with oil. U.S. Pat. Nos. 3,268,071 and 4,033,729 disclose processes involving agglomerating coal particles with oil in order to provide a separation of coal from ash. While these processes can provide some benefication of coal, better removal of ash and iron pyrite mineral matter would be desirable.

The above U.S. Pat. No. 3,268,071 discloses the successive removal of two particulate solid minerals or metals having respectively hydrophilic and hydrophobic surfaces relative to the suspending liquid phase, by staged agglomeration with addition in each stage a separate bridging liquid capable for preferentially wetting respectively the hydrophilic or the hydrophobic surfaces.

The above U.S. Pat. No. 4,033,729 relating to removing inorganic materials (ash) from coal significantly notes that iron pyrite mineral matter has proven difficult to remove because of its apparent hydrophobic character. This disclosure confirms a long-standing problem. The article, "The Use of Oil in Cleaning Coal", Chemical and Metallurgical Engineering, Volume 25, pages 182–188 (1921), discusses in detail cleaning coal by separating ash from coal in a process involving agitating coal-oil-water mixtures, but notes that iron pyrite is not readily removed in such a process.

In a process effecting agglomeration of coal particles, as by contacting with a suitable quantity of oil in an aqueous medium, the physical dimensions of the coal particles are altered. The larger coal agglomerates may suitably be separated from the slurry systems by passage over screens or sieves to retain the enlarged coal particles while permitting passage of unincorporated or unattached mineral matter which retains its original particle size in the aqueous slurry.

Froth flotation techniques have been used for some time, particularly in Europe, for recovery of fine coal. In effect, air bubbles are formed and the solid coal surfaces become attached to the bubbles with the aid of collectors. The most efficient air-solid interfaces form with hydrophobic solids such as coal.

Dissolved gas flotation techniques (as distinguished from dispersed gas flotation) have been used for removing coal and pyrite from slate, clay and other contaminants. A suitable inert gas (air, carbon dioxide, light hydrocarbon) dissolved, for example, in water under pressure will, when pressure is reduced be liberated in very fine bubbles. Such small bubbles are especially effective for solid surfaces attachment, particularly hydrophobic surfaces such as exhibited by coal.

Some recent attention has been given to possible application of the Reichert cone concentrator, a high-capacity wet gravity concentration device developed in Australia, to the removal of ash and inorganic sulfur from coal. It is used commercially for gravity concentration of mineral sands.

Recent studies have also been conducted by the U.S. Bureau of Mines on physical desulfurization of fine-size coals employing the Humphreys spiral concentrator, a mineral-dressing device not heretofore accepted in the coal industry. (Bureau of Mines Report RI-8152/1976).

Other techniques employing density differentials have similarly been considered, as, for example, heavy medium magnatite, hydroclones and centrifugal whirlpool arrangements.

While there is much prior art relating to processes for removing sulfur and ash from coal, there remains a pressing need for a simple, efficient process for removing sulfur and ash from coal. Such a process must maximize recovery of the carbon heating value of the coal as well as reduction of the ash and sulfur content.

SUMMARY OF THE INVENTION

This invention provides a practical method for more effectively reducing the sulfur and ash content of coal. In summary, this invention involves a process for reducing the sulfur and ash content of coal comprising the steps of:

(a) providing an aqueous slurry of coal particles containing ash and pyritic sulfur mineral matter;
(b) adding to the slurry a minor amount of hydrocarbon oil sufficient to effect aggregation of the coal particles;
(c) separating the coal-oil aggregates from the aqueous slurry by dissolved gas flotational means; and
(d) recovering coal-oil aggregates of reduced sulfur content.

If desired, coal particles having a reduced pyritic sulfur and ash content can be recovered from the coal-oil aggregates, particularly by employing a light hydrocarbon oil which may subsequently be stripped from the aggregates. Optionally, prior to aggregation, the slurried coal particles may be contacted with a promoting amount of at least one conditioning agent capable of modifying or altering the existing surface characteristics of the ash and pyritic sulfur mineral matter under conditions whereby there is effected modification or alteration of at least a portion of the contained ash and pyritic sulfur mineral matter.

If the oil is recovered, it may be recycled to the aggregation step. The aqueous slurry may similarly be recycled or separately contacted with additional oil to effect aggregation of any coal particles remaining in the aqueous slurry after separation of the coal-oil aggregates.

Carbon recovery in the coal-oil aggregates is typically from about 85% or greater, often about 90% of the original total amount. By effecting the formation of oil-coal aggregates with successive stages of oil addition, the carbon recovery can be increased to more than 93% of the original value.

A notable advantage of the process of this invention is that significant sulfur reduction is obtained without significant loss of the coal substrate. A desirable result is that sulfur reduction is obtained without the amount and/or heating value of the coal being significantly decreased. Another disadvantage is that ambient conditions (i.e., normal temperatures and atmospheric pressure) can be employed such that process equipment and design is simplified, and less energy is required. Another advantage is that solid waste disposal problems can be reduced.

DETAILED DESCRIPTION OF THE INVENTION

In its broad aspect, this invention provides a method for reducing the sulfur and ash content of coal by a process comprising the steps of:

(a) providing an aqueous slurry of coal particles containing ash and pyritic sulfur mineral matter;
(b) adding to the slurry a minor amount of hydrocarbon oil sufficient to effect aggregation of the coal particles;
(c) separating the oil-coal aggregates from the aqueous slurry by dissolved gas flotational means; and
(d) recovering oil-coal aggregates of reduced sulfur content.

When desired, coal particles having a reduced pyritic sulfur and ash content can be recovered from the oil-coal aggregates, particularly by employing a light hydrocarbon oil which may subsequently be stripped from the aggregate. Optionally, prior to aggregation, the slurried coal particles may be contacted with a promoting amount of at least one conditioning agent capable of modifying or altering the existing surface characteristics of the pyritic sulfur mineral matter and, in many cases, ash under conditions whereby there is effected modification or alteration of at least a portion of the contained ash and pyritic sulfur mineral matter.

The novel process of this invention can substantially reduce the pyritic sulfur content of coal without substantial loss of the amount and/or carbon heating value of the coal. In addition, the process by-products to not present substantial disposal problems.

Carbon recovery in the oil-coal aggregates is typically from about 85% or greater, often about 90% or greater of the original carbon amount. By effecting the formation of oil-coal aggregates with successive stages of oil addition, the carbon recovery can be increased to more than 93% of the original value.

Suitable coals which can be employed in the process of this invention include brown coal, lignite, sub-bituminous, bituminous (high volatile, medium volatile, and low volatile), semi-anthractie, and anthracite. The rank of the feed coal can vary over an extremely wide range and still permit pyritic sulfur removal by the process of this invention. However, bituminous coals and higher ranked coals are preferred. Metallurgical coals, and coals which can be processed to metallurgical coals, containing sulfur in too high a content, can be particularly benefited by the process of this invention. In addition, coal refuse from wash plants which have been used to upgrade run-of-mine coal can also be used as a source of coal. Typically, the coal content of a refuse coal will be from about 25 to about 60% by weight of coal. Particularly preferred refuse coals are refuse from the washing of metallurgical coals.

In the process of this invention, coal particles containing iron pyrite mineral matter may be contacted with a promoting amount of conditioning agent which can modify or alter the surface characteristics of these existing pyrite minerals such that pyrite becomes more amenable to separation upon coal-oil aggregation when compared to the pyritic minerals prior to conditioning. The separation of the coal particles should be effectuated during the time that the surface characteristics of the pyrite are altered or modified. This is particularly true when the conditions of contacting and/or chemical compounds present in the medium can cause realteration or remodification of the surface such as to deleteriously diminish the surface differences between pyrite mineral matter and the coal particles.

Conditioning agents useful herein include inorganic compounds which can hydrolyze in water, preferably under the conditions of use, and the hydrolyzed forms of such inorganic compounds, preferably such forms which exist in effective amounts under the condition of use. Proper pH and temperature conditions are necessary for some inorganic compounds to exist in hydrolyzed form. When this is the case, such proper conditions are employed. The inorganic compounds which are hydrolyzed or exist in hydrolyzed form under the given conditions of contacting (e.g., temperature and pH) can modify or alter the existing surface characteristics of the pyrite. Preferred inorganic compounds are those which hydrolyze to form high surface area inorganic gels in water, such as from about 5 square meters per gram to about 1000 square meters per gram.

Examples of such conditioning agents are the following:

I. Metal Oxides and Hydroxides having the formula:
$M_aO_b \cdot \times P_2O$ and $M(OH)_c \cdot \times H_2O$, wherein M is Al, Fe, Co, Ni, Zn, Ti, Cr, Mn, Mg, Pb, Ca, Ba, Sn, In or Sb; a, b and c are whole numbers dependent upon the ionic valence of M; and x is a whole number within the range from 0 to about 3.

Preferably M is a metal selected from the group consisting of Al, Fe, Mg, Sn, Zn, Ca and Ba. These metal oxides and hydroxides are known materials. Examples of such materials are aluminum hydroxide gels in water at pH 7 to 7.5. Such compounds can be readily formed by mixing aqueous solutions of water-soluble aluminum compounds, for example, aluminum nitrate or aluminum acetate, with suitable hydroxides, for example, ammonium hydroxide. In addition, a suitable conditioning agent is formed by hydrolyzing bauxite ($Al_2O_3 \cdot \times H_2O$) in alkaline medium to an alumina gel. Stanous hydroxide, ferrous hydroxide and zinc hydroxide are preferred conditioning agents. Calcium hydroxide represents another preferred conditioning agent. Calcined calcium and magnesium oxides, and their hydroxides as set forth above, are also preferred conditioning agents. Mixtures of such compounds can very suitably be employed. The compounds are preferably suitably hydrolyzed prior to contacting with coal particles in accordance with the invention.

II. Metal aluminates having the formula:
$M'_d(A10_3)_e$ or $M'_f(A10_2)_g$, wherein M' is Fe, Co, Ni, Zn, Mg, Pb, Ca, Ba, or Mo; and d, e, f and g are whole numbers dependent on the ionic valence of M'.

Compounds wherein M' is Fe, Ca or Mg, i.e., iron, calcium and magnesium aluminates are preferred. These preferred compounds can be readily formed by mixing aqueous solutions of water-soluble calcium and magnesium compounds, for example, calcium or magnesium acetate with sodium aluminate. Mixtures of metal aluminates can very suitably be employed. The compounds are most suitably hydrolyzed prior to contacting with coal particles in accordance with the invention.

III. Aluminosilicates having the formula:
$Al_2O_3.xSiO_2$, wherein x is a number within the range from about 0.5 to about 5.0.

A preferred aluminosilicate conditioning agent for use herein has the formula $Al_2O_3.4SiO_2$. Suitable aluminosilicates for use herein can be formed by mixing together in aqueous solution a water-soluble aluminum compound, for example, aluminum acetate, and a suitable alkali metal silicate, for example, sodium metasilicate, preferably, in suitable stoichiometric amounts to provide preferred compounds set forth above.

IV. Metal silicates wherein the metal is calcium, magnesium, barium, iron or tin.

Metal silicates can be complex mixtures of compounds containing one or more of the above mentioned metals. Such mixtures can be quite suitable for use as conditioning agents.

Calcium and magnesium silicates and mixtures thereof are among the preferred conditioning agents of this invention.

These conditioning agents can be prepared by mixing appropriate water-soluble metal materials and alkali metal silicates together in an aqueous medium. For example, calcium and magnesium silicates, which are among the preferred conditioning agents, can be prepared by adding a water soluble calcium and/or magnesium salt to an aqueous solution or dispersion of alkali metal silicate.

Suitable alkali metal silicates which can be used for forming the preferred conditioning agents are potassium silicates and sodium silicates. Alkali metal silicates for forming preferred calcium and magnesium conditioning agents for use herein are compounds having $SiO_2:M_2O$ formula weight ratios up to 4:1, wherein M represents an alkali metal, for example, K or Na.

Alkali metal silicate products having silica-to-alkali weight ratios ($SiO_2:M_2O$) up to about 2 are water-soluble, whereas those in which the ratio is above about 2.5 exhibit less water solubility, but can be dissolved by steam under pressure to provide viscous aqueous solutions or dispersions.

The alkali metal silicates for forming preferred conditioning agents are the readily available potassium and sodium silicates having $SiO_2:M_2O$ formula weight ratios up to 2:1. Examples of specific alkali metal silicates are anhydrous $Na_2SiO_3$ (sodium metasilicate), $Na_2Si_2O_5$ (sodium disilicate), $Na_4SiO_4$ (sodium orthosilicate), $Na_6Si_2O_7$ (sodium pyrosilicate) and hydrates, for example, $Na_2SiO_3.nH_2O$ (n=5,6,8 and 9), $Na_2Si_4O_9.7H_2O$ and $Na_3HSiO_4.5H_2O$. Examples of suitable water-soluble calcium and magnesium salts are calcium nitrate, calcium hydroxide and magnesium nitrate. The calcium and magnesium salts when mixed with alkali metal silicates described hereinbefore form very suitable conditioning agents for use herein.

Calcium silicates which hydrolyze to form tobermorite gels are especially preferred conditioning agents for use in the process of the invention.

V. Inorganic Cement Materials

Inorganic cement materials are among the preferred conditioning agents of the invention. As used herein, cement material means an inorganic substance capable of developing adhesive and cohesive properties such that the materials can become attached to mineral matter. Cement materials can be discrete chemical compounds, but most often are complex mixtures of compounds. The most preferred cements (and fortunately, the most readily available cements) are those cements capable of being hydrolyzed under ambient conditions, the preferred conditions of contacting with coal in the process of this invention.

These preferred cement materials are inorganic materials which, when mixed with a selected proportion of water, form a paste that can set and harden. Cement and materials used to form cements are discussed in Kirk-Othmer, Encyclopedia of Chemical Technology, 2nd Edition, Volume 4, (1964) John Wiley & Sons, Inc., Pages 684 to 710 thereof are incorporated herein by reference. Examples of cement materials include calcium silicates, calcium aluminates, calcined limestone and gypsum. Especially preferred examples of cement materials are the materials employed in hydraulic limes, natural cement, masonry cement, pozzolan cement and portland cement. Such materials will often include magnesium cations in addition to calcium, e.g., dolomite.

Commercial cement materials, which are very suitable for use herein, are generally formed by sintering calcium carbonate (as limestone), or calcium carbonate (as limestone) with aluminum silicates (as clay or shale). Preferably, such materials are hydrolyzed prior to use as conditioning agents.

With some coals, the mineral matter associated with the coal may be such that on treatment under proper conditions of temperature and pH the mineral matter can be modified in situ to provide the suitable hydrolyzed inorganic conditioning agents for carrying out the process. In such cases, additional conditioning agents may or may not be required depending on whether an effective amount of conditioning agent is generated in situ.

The conditioning agents suitable for use herein can be employed alone or in combination.

The coal particles employed in this invention can be provided by a variety of known processes, for example, by grinding or crushing, usually in the presence of water.

The particle size of the coal can vary over wide ranges. In general, the particles should be of a size to promote the removal of pyritic sulfur upon contacting with conditioning agent in the aqueous medium. For instance, the coal may range from an average particle size of one-eighth inch in diameter to as small as minus 400 mesh (Tyler Screen) or smaller. Depending on the occurrence and mode of physical distribution of pyritic sulfur in the coal, the rate of sulfur removal will vary. In general, if the pyrite particles are relatively large and are liberated readily upon grinding, the sulfur removal rate will be faster and the sulfur removal will be substantial. If the pyrite particles are small and associated with the coal through surface contact or encapsulation, then the degree of grinding will have to be increased in order to provide for liberation of the pyrite particles. In a preferred embodiment of this invention, the coal particles are reduced in size sufficiently to effectuate liberation of sulfur and ash content and efficiency of conditioning. A very suitable particle size is often minus 24 mesh, or even minus 48 mesh as such sizes are readily separated on screen and sieve bends. For coals having fine pyrite distributed through the coal matrix, particle size distribution wherein from about 50 to about 85% preferably from about 60 to about 75% pass through minus 200 mesh is a preferred feed with top sizes as set forth above.

When a conditioning agent is employed, the coal particles are preferably contacted therewith in an aqueous medium by forming a mixture of the coal particles, conditioning agent and water. The mixture can be formed, for example, by grinding coal in the presence of water and adding a suitable amount of conditioning agent. Another very suitable contacting method involves forming an aqueous mix of conditioning agent, water and coal and then crushing the coal with the aqueous mix of conditioning agent, for example, in a ball mill, to particles of a suitable size. Preferably, the aqueous medium contains from about 5% to about 50%, more preferably from about 5 to about 30%, by weight of the aqueous medium, of coal particles.

The coal particles are contacted for a period of time and under conditions of temperature and pressure sufficient to modify or alter the existing surface characteristics of the pyritic mineral matter sulfur in the coal such that it becomes more amenable to separation from the coal when the coal is oil-aggregated. The optimum time will depend upon the particular reaction conditions and the particular coal employed. Generally, a time period in the range of from about 1 minute to 2 hours or more, can be satisfactorily employed. Preferably, a time period of from 10 minutes to 1 hour is employed. During this time, agitation can be desirably employed to enhance contacting. Known mechanical mixers, for example, can be employed.

An amount of conditioning agent is employed which is sufficient to promote the separation of pyrite and ash from coal. Generally, the proportion of conditioning agent, based on coal, will be within the range from about 0.01 to 15 wt. %, desirably within the range from about 0.05 to 10 wt. %, and preferably within the range from about 0.5 to 5 wt. %.

Because one of the major results sought is an effective diminution in overall mineral matter content of the treated coal particles, it is usually preferred to base the dosage of conditioning agent upon the mineral matter content of the coal. Depending upon the type and source of the feed coal, the mineral matter content may vary widely and is generally within the range from about 5 to about 60 wt. %, and usually from about 10 to about 40 wt. %, based on the feed coal. Dosage of the conditioning agent may vary within the range from about 0.05 to 30 wt. %, preferably about 0.10 to 15 wt.

%, and most preferably from about 1.0 to 10 wt. %, based on mineral matter.

Preferably, the coal is contacted with the conditioning agent in aqueous medium. The contacting is carried out at a temperature such to modify or alter the pyritic surface characteristics. For example, temperatures in the range of about 0° C. to 100° C., can be employed, preferably from about 20° C. to about 70° C., and still more preferably from about 20° C. to about 35° C., i.e. ambient conditions. Temperatures above 100° C. can be employed, but are not generally preferred since a pressurized vessel would be required. Temperatures in excess of 100° C. and pressures above atmospheric, generally pressures of from about 5 psig to about 500 psig, can be employed, however, and can even be preferred when a processing advantage is obtained. Elevated temperatures can also be useful if the viscosity and/or pour point of the aggregating oil employed is too high at ambient temperatures to selectively aggregate coal.

As stated above, the conditions of contacting are adjusted in order to effectuate the alteration or modification of the pyrite surface. During such time when the surface characteristics are altered or modified the coal particles are separated by aggregation before significant deterioration of the surface characteristics occurs.

The process step whereby the sulfur-containing coal particles are contacted with conditioning agent in aqueous medium may be carried out in any conventional manner, e.g. batchwise, semi-batchwise or continuously. Since ambient temperatures can be used, conventional equipment will be suitable.

An amount of hydrocarbon oil necessary to form coal hydrocarbon oil aggregates can be present during this conditioning step. Alternatively, and preferably, after the coal particles have been contacted with the conditioning agent in aqueous solution for a sufficient time, the coal particles are aggregated with hydrocarbon oil.

The hydrocarbon oil employed may be derived from sources such as petroleum, shale oil, tar sand or coal. Petroleum oils are generally to be preferred primarily because of their ready availability and effectiveness. Coal liquids and aromatic oils are particularly effective. Suitable petroleum oils will have a moderate viscosity, so that slurrying will not be rendered difficult, and a relatively high flash point, so that safe working conditions can be readily maintained. Such petroleum oils may be either wide-boiling range or narrow-boiling range fractions; may be paraffinic, naphthenic or aromatic; and preferably are selected from among light cycle oils, heavy cycle oils, clarified oils, gas oils, vacuum gas oils, kerosenes light and heavy naphthas, and mixtures thereof. In some instances decanted or asphaltic oils may be used.

As used herein "coal aggregate" means a small aggregate or floc formed of several coal particles such that the aggregate is at least about two times, preferably from about three to twenty times, the average size of the coal particles which make up the aggregate. Such small aggregates are to be distinguished from spherical agglomerates which include a large plurality of particles such that the agglomerate size is quite large and generally spherical. For example, agglomerates in the shape of balls having diameters of from about ⅛ inch to ½ inch, or larger, may be formed. Such agglomerates generally form in the presence of larger proportions of oil.

The oil phase is desirably added as an emulsion in water. The preferred method is to effect emulsification mechanically by the shearing action of a high-speed stirring mechanism. Such emulsions should be contacted rapidly and as an emulsion with the coal-water slurry. Where such contacting is not feasible, the use of emulsifiers to maintain oil-in-water emulsion stability may be employed, particularly non-ionic emulsifiers. In some instances, the emulsification is effected in sufficient degree by the agitation of water, hydrocarbon oil and coal particles.

In the process of this invention, it is preferred to add the hydrocarbon oil, emulsified or otherwise, to the aqueous medium of coal particles and agitate the resulting mixture to aggregate the coal particles. If necessary, the water content of the mixture can be adjusted to provide for optimum aggregation. Generally from about 50 to 99 parts, preferably from about 60 to 95 parts, and more preferably from 70 to 95 parts water, based on 100 parts of the coal-water feed, is most suitable for aggregation. There should be sufficient hydrocarbon oil present to aggregate the coal particles, but this amount should preferably be held to the minimum amount required for a suitable degree of aggregation. The optimum amount of hydrocarbon oil will depend upon the particular hydrocarbon oil employed, as well as the size and rank of the coal particles. Generally, the amount of hydrocarbon oil will be from about 1 to 15 wt. %, desirably from about 2 to 10 wt. %, based on coal. Most preferably the amount of hydrocarbon oil will be from about 3 to 8 wt. %, based on coal.

Agitating the mixture of water, hydrocarbon oil and coal particles to form coal-oil aggregates can be suitably accomplished using stirred tanks, ball mills or other apparatus. Temperature, pressure and time of contacting may be varied over a wide range of conditions, generally including the same ranges employed in conditioning the particles. In the course of optimizing the use of oil in the aggregation step, the oil phase, whether in emulsified form or not, is preferably added in small increments until the desired total quantity of oil is present. The resulting coal-oil aggregates posses limited cohesive strength but, if broken, as by shearing, readily form again and consequently afford a new solid phase.

Any process employed for aggregation of coal particles with oil effectively increases the particle size of the aggregate at least several fold over that of the untreated coal particle. Similarly the inclusion of oil in the aggregate as well as possible inclusion or attachment of air or other gas serves to decrease the apparent density, or specific gravity, of the coal particles relative to pyrite, ash, and any unmodified coal particles.

Such coal-oil aggregates possess a surprising degree of structural integrity. Less inclusion of pyrite and other mineral matter occurs. Accordingly, better rejection of pyrite and other mineral matter is effected than is experienced with either spherical agglomerates or froth flotation techniques.

Coal-oil aggregates are separated from the aqueous slurry by dissolved gas flotational means. Coal-oil aggregates are rendered substantially lighter in density by treating to effect attachment or inclusion of gas bubbles such that the aggregates can be separated by flotational means. It has been found that a particularly effective method for making such a separation involves introducing dissolved gas into an aqueous slurry of coal-oil aggregates under super atmospheric pressure, and subsequently reducing the pressure, for example, in a flotation chamber. This technique affords very fine gas bubbles as the pressure is reduced which readily associate with the coal-oil aggregates (by attached or inclusion) such that flotation of the aggregates is improved.

A particularly effective method of introducing dissolved gas into the aqueous slurry of coal-oil aggregates involves contacting the aqueous slurry of coal-oil aggregates with gas under super atmospheric pressure to dissolve gas into the aqueous phase. Another method involves introducing to the aqueous slurry of coal-oil aggregates water containing gas dissolved under pressure. Suitable gases include those which are substantially non-deleterious to the coal, such as air, carbon dioxide, nitrogen, methane and other light hydrocarbon bases. The generally preferred gas is air. This flotation may be conducted at temperatures within the range from about 0° to about 100° C., preferably within the range from about 10° C. to about 50° C. Dissolved gas flotation may be effected at pressures ranging from about 1 to about 200 p.s.i.g., preferably from about 5 to about 100 p.s.i.g.

Suitable dissolved gas flotational means involve exposure of coal-oil aggregates to the action of extremely fine gas bubbles with the formation of a gas-solid interface. Such gas-solid interfaces form most readily and remain effective longest with solids having a substantially hydrophobic character. Coal is rendered quite hydrophobic when intimately associated with oil. Relatively, the more hydrophilic nature of the ash and pyritic mineral matter, particularly when subjected to conditioning treatment, renders such solids less amenable to the formation of gas-solid interfaces. Employing, for example, air or carbon dioxide as the gas held under pressure in the aqueous slurry, the aqueous slurry is introduced to a flotation chamber and the pressure is slowly reduced. Preferably, the pressure is reduced by discharging the aqueous slurry containing dissolved gas through an orifice or a value into a zone of reduced pressure. Another method of reducing pressure is to discharge the pressurized gas to a zone of reduced pressure. The gas liberated by the sudden pressure drop is precipitated as extremely fine bubbles, for example, bubbles having a diameter of 80–100 microns. These bubbles possess a relatively large surface-volume ratio and are most effective at forming hydrophobic solid-gas interfaces. The coal-oil aggregates, associated with the gas bubbles, rise through the flotation zone and can readily be separated in a variety of ways, for example by skimming or by spilling over a weir into a collector. The lean aqueous slurry is then rejected together with any coal particles remaining with the ash and pyritic mineral matter.

After the separation step coal particles may be recovered from the coal-oil flocs by washing with a light oil such as naphtha, drying as required, and sending to storage or to downstream usage. When the total proportion of oil is small, it is preferred to leave the oil in association with the coal particles whenever such action will not substantially affect the intended downstream usage. Alternatively, the recovered coal or aggregate may be pelletized.

Recovered coal particles may be subjected to subsequent treatment for further beneficiation if desired. Although such reprocessing treatment is often not necessary or desirable, there may be a signigicant residue of coal particles remaining with the rejected ash and pyritic mineral matter in the lean aqueous slurry. Such coal particles may be subjected to further grinding, preferably wet grinding in the presence of a conditioning agent, prior to subsequent treatment. Recycle of the lean aqueous slurry with either fresh or recovered oil thus serves to improve the overall recovery of coal particles with the attendant preservation of substantially the original carbon heating value.

In another separation arrangement whereby residual carbon heating values are recovered from the lean aqueous slurry, reprocessing comprises a regrinding step, an aggregation step, and a second separation step employing a separation means different from that employed in the first separation step. In one example of this type of arrangement, the second separation is conducted employing a centrifugal separation means.

The resulting coal product can exhibit a diminished non-pyritic sulfur content; for example, in some coals up to 30%, by weight, of non-pyritic sulfur (i.e., sulfate, sulfur and/or apparent organic sulfur) may be removed. Additionally, reduction in ash content is typically from about 20 to 80 wt %, or even higher.

One aspect of this invention is the discovery that conditioning agents employed herein modify the pyrite and other mineral matter such that the pyrite may be less susceptible to weathering and all of the mineral components separate from water more cleanly and quickly. The result is that disposal problems associated with these materials are substantially reduced, e.g. ease of dewatering in the case of separation, less acid runoff, and the like. In addition, since substantially all of the organic coal treated in the process of this invention can be recovered, unrecovered coal does not present a disposal problem, such as spontaneous combustion, which can occur in refuse piles.

It is another aspect of this invention that coal recovered from the process exhibits substantially improved fouling and slagging properties. Thus, the process can provide for improved removal of those inorganic constituents which cause high fouling and slagging in combustion furnaces.

What is claimed is:

1. A process for reducing the sulfur and ash content of coal comprising the steps of:
   (a) providing an aqueous slurry of coal particles containing ash and pyritic sulfur mineral matter;
   (b) adding to the slurry and minor amount of hydrocarbon oil sufficient to effect aggregation of the coal particles;
   (c) separating the coal-oil aggregates from the aqueous slurry by dissolved gas flotational means; and
   (d) recovering coal-oil aggregates of reduced sulfur.

2. The process of claim 1 wherein the hydrocarbon oil is derived from petroleum, shale oil, tar sands or coal.

3. The process of claim 1 wherein the hydrocarbon oil is selected from the group consisting of light cycle oil, heavy cycle oil, gas oil, vacuum gas oil, clarified oil, kerosene, light naphtha, and heavy naphtha.

4. The process of claim 1 wherein the hydrocarbon oil is added to the slurry as an emulsion in water.

5. The process of claim 1 wherein the aggregation of coal particles is effected by adding hydrocarbon oil to the slurry at a temperature within the range from 0° to 100° C.

6. The process of claim 5 wherein the aggregation of coal particles is effected by adding hydrocarbon oil to the slurry at a temperature within the range from 20° to 70° C.

7. The process of claim 5 wherein the hydrocarbon oil is added to the slurry as an emulsion in water.

8. The process of claim 1 wherein the coal-oil aggregates contain from about 2 wt. % to about 10 wt. %, based on coal, of hydrocarbon oil.

9. The process of claim 1 wherein the coal-oil aggregates contain from about 3 wt. % to about 8 wt. %, based on coal, of hydrocarbon oil.

10. The process of claim 1 wherein the coal particles are minus 24 mesh, and the gas flotation means is a gas dissolved in the aqueous slurry under super-atmospheric pressure and the aqueous slurry is introduced to a flotation chamber such that at least a portion of the coal-oil aggregates float.

11. The process of claim 10 wherein the coal particles are minus 48 mesh the gas dissolved in the aqueous slurry is selected from the group consisting of air, carbon dioxide, nitrogen and methane under a pressure of from 1 to 200 psig.

12. The process of claim 11 wherein the dissolved gas is air.

13. The process of claim 11 wherein the floating coal-oil aggregates are separated from the aqueous slurry by skimming.

14. The process of claim 1 wherein coal particles having a reduced pyritic sulfur and ash content are recovered from the recovered size-modified coal-oil aggregates.

15. The process of claim 1 wherein the coal is selected from the group consisting of bituminous and higher ranked coal.

16. The process of claim 1 wherein the ash content of the recovered coal is reduced by at least about 20%.

17. The process of claim 1 wherein the pyritic sulfur content of the recovered coal is reduced by at least about 40%.

18. The process of claim 1 wherein, prior to aggregation, the slurried coal particles are contacted with a promoting amount of at least one conditioning agent capable of modifying or altering the existing surface characteristics of the ash and pyritic sulfur mineral matter under conditions whereby there is effected modification or alteration of at least a portion of the contained ash and pyritic sulfur mineral matter.

19. The process of claim 18 wherein the conditioning agent is an inorganic compound capable of hydrolyzing in the presence of water.

20. The process of claim 19 wherein the conditioning agent is an inorganic compound hydrolyzable in water to form a high surface area inorganic gel.

21. The process of claim 19 wherein the conditioning agent is selected from the group consisting of metal oxides and hydroxides having the formula $M_aO_b \cdot \times H_2O$ or $M(OH)_c \cdot \times H_2O$ wherein M is Al, Fe, Co, Ni, Zn, Ti, Cr, Mn, Mg, Pb, Ca, Ba, In or Sb; a, b and c are whole numbers dependent upon the ionic valence of M; and x is a whole number within the range from 0 to 3.

22. The process of claim 21 wherein the conditioning agent is selected from the group consisting of calcium oxide, magnesium oxide and mixtures thereof.

23. The process of claim 21 wherein the conditioning agent is selected from the group consisting of aluminum oxide, aluminum hydroxide and mixtures thereof, hydrolyzed in water to form an alumina gel.

24. The process of claim 18 wherein the conditioning agent is selected from the group consisting of metal aluminates having the formula $M'_d(Al\ O_3)_e$ or $M'_f(Al\ O_2)_g$, wherein M' is Fe, Co, Ni, Zn, Mg, Pb, Ca, Ba or Mo; and de, e, f and g are whole numbers dependent upon the ionic valence of M'.

25. The process of claim 24 wherein the conditioning agent is selected from the group consisting of calcium, magnesium, and iron aluminates and mixtures thereof.

26. The process of claim 18 wherein the conditioning agent is selected from the group consisting of aluminosilicates having the formula $Al_2O_3 \cdot \times SiO_2$, wherein x is a number within the range from about 0.5 to about 5.0.

27. The process of claim 18 wherein the conditioning agent is selected from the group consisting of metal silicates wherein the metal is calcium, magnesium, barium, iron or tin.

28. The process of claim 27 wherein the conditioning agent is selected from the group consisting of calcium silicate, magnesium silicate and mixtures thereof.

29. The process of claim 18 wherein the conditioning agent is selected from the group consisting of inorganic cement materials capable of binding mineral matter.

30. The process of claim 29 wherein the conditioning agent is selected from the group consisting of portland cement, natureal cement, masonry cement, pozzolan cement, calcined limestone and calcined dolomite.

31. The process of claim 30 wherein the cement material is hydrolyzed portland cement.

* * * * *